US007829252B2

(12) United States Patent
Yu

(10) Patent No.: US 7,829,252 B2
(45) Date of Patent: Nov. 9, 2010

(54) IMAGING MEMBER

(75) Inventor: Robert C. U. Yu, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 449 days.

(21) Appl. No.: 11/220,771

(22) Filed: Sep. 7, 2005

(65) Prior Publication Data

US 2007/0054208 A1 Mar. 8, 2007

(51) Int. Cl.
*G03G 5/10* (2006.01)

(52) U.S. Cl. ..... 430/69; 399/406; 430/533; 430/930; 430/412

(58) Field of Classification Search ..... 430/69; 399/406; 428/412
See application file for complete search history.

(56) References Cited

U.S. PATENT DOCUMENTS 3,121,006 A 2/1964 Middleton et al.
3,357,989 A 12/1967 Byrne et al.
3,442,781 A 5/1969 Weinberger
4,286,033 A 8/1981 Neyhart et al.
4,291,110 A 9/1981 Lee
4,338,387 A 7/1982 Hewitt
4,415,693 A 11/1983 Chen et al.
5,919,590 A * 7/1999 Yu et al. ..... 358/1.15
2004/0214100 A1* 10/2004 Yu et al. ..... 430/58.8
2006/0099525 A1* 5/2006 Yu et al. ..... 430/58.05

* cited by examiner

*Primary Examiner*—Mark F Huff
*Assistant Examiner*—Rachel L Burney
(74) *Attorney, Agent, or Firm*—Fay Sharpe LLP

(57) ABSTRACT

An imaging member having an enhanced anti-curl back coating is disclosed. The anti-curl back coating comprises a liquid oligomer. Additionally, a slip agent can also be included. The resulting anti-curl back coating contains little to no residual solvent, shows improved resistance to wear and ozonolysis, and increased lubricity to prevent static charge built-up.

10 Claims, 1 Drawing Sheet

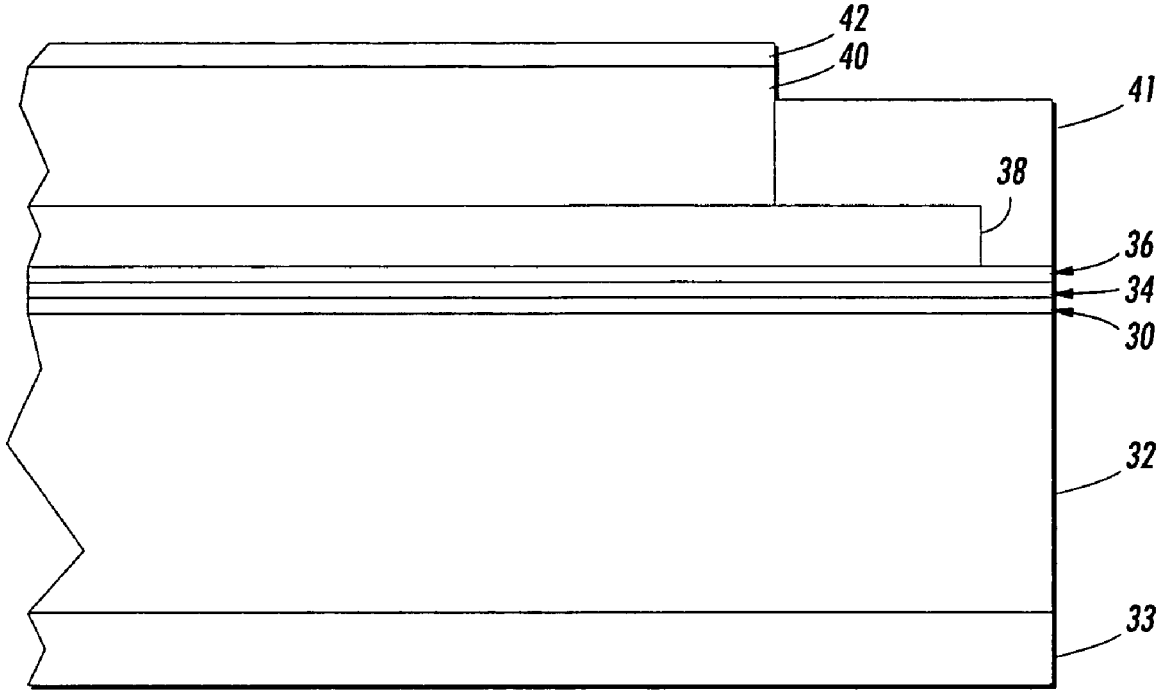
42
40
41
38
36
34
30
32
33

IMAGING MEMBER

BACKGROUND

This disclosure relates, in various embodiments, to electrostatographic imaging members. The imaging members described herein are flexible electrostatographic imaging members which can be used as photosensitive members, photoreceptors or photoconductors useful in electrophotographic systems, including printers, copiers, other reproductive devices, and digital apparatuses. More particularly, the imaging members of this disclosure comprise an improved anti-curl back coating.

Flexible electrostatographic imaging members are well known in the art. Typical flexible electrostatographic imaging members include, for example: (1) electrophotographic imaging member belts (photoreceptors) commonly utilized in electrophotographic (xerographic) processing systems; (2) electroreceptors such as ionographic imaging member belts for electrographic imaging systems; and (3) intermediate toner image transfer members such as an intermediate toner image transferring belt which is used to remove the toner images from a photoreceptor surface and then transfer the very images onto a receiving paper. The flexible electrostatographic imaging members may be seamless or seamed belts. Typical electrophotographic imaging member belts include a charge transport layer and a charge generating layer on one side of a supporting substrate layer and an anti-curl back coating coated onto the opposite side of the substrate layer. An electrographic imaging member belt may, however, have a more simple material structure; it may have a dielectric imaging layer on one side of a supporting substrate and an anti-curl back coating on the opposite side of the substrate to render flatness. Although the scope of the present disclosure covers the preparation of all types of flexible electrostatographic imaging members, for reasons of simplicity, the discussion hereinafter will focus only on flexible electrophotographic imaging members.

Electrophotographic flexible imaging members may include a photoconductive layer including a single layer or composite layers. Since typical electrophotographic imaging members exhibit undesirable upward imaging member curling, an anti-curl back coating, applied to the backside, is required to balance the curl. Thus, the application of an anti-curl back coating is necessary to provide the appropriate imaging member with desirable flatness.

Electrophotographic imaging members, such as photoreceptors or photoconductors, typically include a photoconductive layer formed on a flexible electrically conductive substrate or formed on layers between the substrate and photoconductive layer. The photoconductive layer is an insulator in the dark, so that during machine imaging processes, electric charges are retained on its surface. Upon exposure to light, the charge is dissipated, and an image can be formed thereon, developed using a developer material, transferred to a copy substrate, and fused thereto to form a copy or print.

Typical negatively-charged imaging member belts, such as flexible photoreceptor belt designs, are made of multiple layers comprising a flexible supporting substrate, a conductive ground plane, a charge blocking layer, an optional adhesive layer, a charge generating layer, a charge transport layer. The charge transport layer is usually the last layer to be coated and is applied by solution coating followed by drying at elevated temperatures, then cooling to ambient room temperature. When a production web stock of several thousand feet of coated multilayered photoreceptor material is obtained after finishing the charge transport layer coating and drying/cooling process, upward curling of the multilayered photoreceptor is observed.

This upward curling is a consequence of thermal contraction mismatch between the charge transport layer and the substrate support. Because the charge transport layer in a typical prior art photoreceptor device has a coefficient of thermal contraction approximately 3.7 times greater than that of the flexible substrate support, the charge transport layer contracts more than the substrate support as it cools down to ambient room temperature. The resulting internal tension strain in the charge transport layer causes the photoreceptor to exhibit upward curling. If unrestrained, the photoreceptor would spontaneously curl upwardly into a 1.5-inch tube. To offset this curl and keep the photoreceptor web stock flat, an anti-curl back coating (ACBC) is applied to the backside of the flexible substrate support, opposite to the side having the charge transport layer.

The ACBC is typically applied to the imaging member by a solution coating process. Typical ACBC coating solutions generally contain a film forming polymer, a small amount of a polyester adhesion promoter, and an organic solvent(s), such as methylene chloride or a chlorinated solvent. After application of the coating solution to the back surface of the imaging member, the wet ACBC is dried at elevated temperatures to remove a substantial amount of the solvent to produce a solid layer. However, not all of the solvent may be removed from the ACBC during drying. For example, in forming a typical layer from a coating solution containing about 86 weight-% (wt-%) methylene chloride solvent and 14 wt-% dissolved solids, the solvent evaporates very quickly during the elevated temperature drying process. However, about 1.4 wt-% to 2 wt-% of the methylene chloride will generally still be present or trapped in the resulting ACBC (i.e., residual methylene chloride). The trapped solvent evaporates or "outgases" over time. The outgassed solvent, as vapor, can damage the charge transport layer either while it is in its original package or during cyclic belt function inside a machine cavity, causing premature charge transport layer cracking and shortening the imaging belt's service life.

Additionally, because the anti-curl back coating is on the backside of the substrate support, it directly interacts with the machine belt support rollers and backer bars; this causes substantial wear of the ACBC. This mechanical interaction has also been seen to promote ACBC static charge-up, producing substantial belt drive torque increases and, in some cases, resulting in absolute belt cyclic motion stalling. The wear on the anti-curl back coating also generates dust inside the machine cavity, causing undesirable dusty operating conditions. ACBC wear also reduces the thickness of the anti-curl layer, diminishing its ability to keep the photoreceptor belt flat.

Furthermore, under typical machine electrophotographic imaging conditions, ozone is constantly being generated by the charging device(s) and fills the machine cavity. This ozone exposure has been found to cause polymer chain scission in the ACBC, which weakens its mechanical property and exacerbates the ACBC wear problem.

In this regard, when the ACBC wears, its ability to reduce upward belt curling decreases. This upward belt curling, caused by loss of ACBC thickness, produces significant surface distance variations between the photoreceptor belt surface and the machine charging device. These variations cause non-uniform charging density over the photoreceptor belt surface, degrading copy printout quality. Thus, ACBC wear can cause visible defects in the printed image. When the imaging members curl upward, they may also physically interact/interfere with other xerographic subsystems; this will also lead to undesirable artifacts in a printed image.

Consequently, there continues to be a need for imaging members having an anti-curl back coating which contains little or no residual solvent, can reduce wear by suppressing or eliminating the effects of polymer chain scission and/or reducing surface friction between the ACBC and machine parts.

REFERENCES

Illustrated in copending U.S. patent application Ser. No. 10/422,668, filed Apr. 24, 2003, by Robert Yu et al., the disclosure of which is totally incorporated herein by reference, is a photoconductive imaging member containing a photogenerating layer and a charge transport layer, wherein the charge transport layer comprises a vinyl-containing organic compound.

Copending U.S. Patent Application (20041188-US-NP, XERZ 2 00965), which is also totally incorporated herein by reference, discloses an imaging member with a charge transport layer comprising a bis(allyl carbonate) of bisphenol A and a process for making the imaging member.

BRIEF DESCRIPTION

There are disclosed herein, in various embodiments, processes and compositions for extending the functional life of a flexible electrophotographic imaging member. These processes and compositions relate generally to an imaging member with a mechanically robust anti-curl back coating (ACBC) which has increased wear and ozone attack resistance, greater surface lubricity, no static charge-up, and/or little to no residual solvent content. Such an imaging member exhibits increased service life under normal operating conditions in the field.

In an exemplary embodiment, the anti-curl back coating comprises a film-forming polymer resin binder and a liquid oligomer. The liquid oligomer comprises from about 2 to about 10 wt-% of the anti-curl back coating, based on the total weight of the anti-curl back coating. In further specific embodiments, the liquid oligomer comprises about 5 wt-% of the anti-curl back coating.

In another exemplary embodiment, the liquid oligomer is a diethylene glycol bis(allyl carbonate) represented by Formula (I):

FORMULA (I)

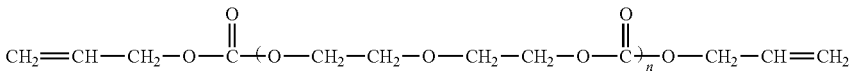

wherein n is an integer from about 1 to about 6. In a specific embodiment, n=1.

In a further exemplary embodiment, the liquid oligomer is a bis(allyl carbonate) of Bisphenol A shown as Formula (II) below:

FORMULA (II)

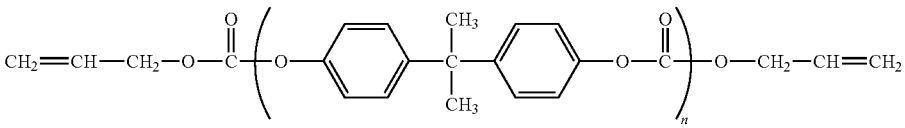

wherein n is an integer from about 1 to about 6. In a specific embodiment, n=1 and the liquid oligomer carbonate is bis (allyl carbonate) of bisphenol A.

In still another exemplary embodiment, the liquid oligomer is a polystyrene represented by Formula (III) below:

FORMULA (III)

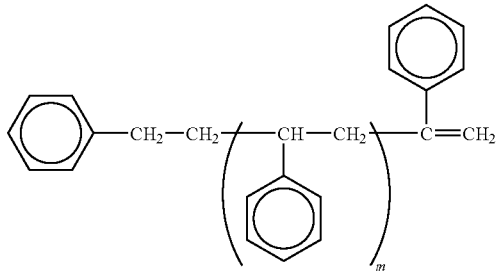

wherein m is the degree of polymerization and m is an integer from about 3 to about 10.

In a further embodiment, the anti-curl back coating comprises a film-forming polymer resin binder, a liquid oligomer, and a slip agent. The slip agent comprises from about 0.01 to about 5 wt-% of the anti-curl back coating, based on the total weight of the anti-curl back coating. In further specific embodiments, the liquid oligomer comprises from about 0.5 to about 4 wt-% of the anti-curl back coating.

In one such exemplary embodiment, the slip agent is a liquid polyester modified polysiloxane represented by Formula (IV) below:

FORMULA (IV)

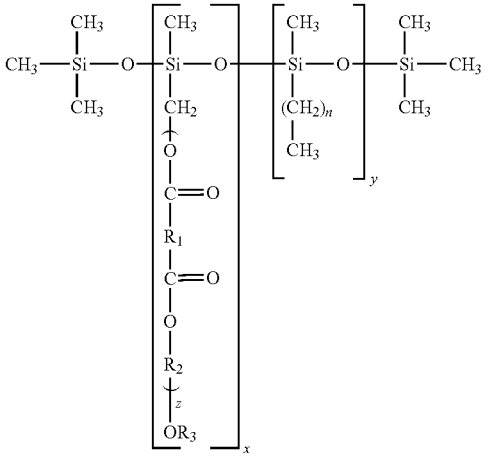

wherein $R_1$ and $R_2$ are independently selected from alkylene groups containing from 1 to 10 carbon atoms; $R_3$ is hydrogen or alkyl having 1 to 3 carbon atoms; n is an integer from 0 to 10; x and y are independently integers from 5 to 500; and z is an integer from 1 to 30. The slip agent may lower surface energy as well as suppress ozone attack.

These and other non-limiting features and characteristics of the embodiments of the present disclosure are more particularly described below.

BRIEF DESCRIPTION OF THE DRAWINGS

The following is a brief description of the drawings, which are presented for the purposes of illustrating the exemplary embodiments disclosed herein and not for the purposes of limiting the same.

FIG. 1 is a schematic cross-sectional view of an exemplary embodiment of a negatively charged imaging member having an anti-curl back coating.

DETAILED DESCRIPTION

Disclosed herein, in various embodiments, are photoconductive imaging members having improved anti-curl back coatings and methods for producing such imaging members. The imaging members of this development can be used in a number of different known imaging and printing processes including, for example, electrophotographic imaging processes, especially xerographic imaging and printing processes wherein charged latent images are rendered visible with toner compositions of an appropriate charge polarity. Moreover, the imaging members of this disclosure are also useful in color xerographic applications, particularly high-speed color copying and printing processes. In these applications, the imaging members are in embodiments sensitive in the wavelength region of from about 500 to about 900 nanometers, and in particular from about 650 to about 850 nanometers; thus, diode lasers can be selected as the light source.

The exemplary embodiments of this disclosure are more particularly described below with reference to the drawings. Although specific terms are used in the following description for clarity, these terms are intended to refer only to the particular structure of the various embodiments selected for illustration in the drawings and not to define or limit the scope of the disclosure. The structures in the FIGURE are not drawn according to their relative proportions and the drawing should not be interpreted as limiting the disclosure in size, relative size, or location. In addition, though the discussion will address flexible imaging members used in negatively charged systems, the imaging members of the present disclosure may also be designed for use in positively charged systems.

An exemplary embodiment of the negatively charged imaging member of the present disclosure is illustrated in FIG. 1. The substrate 32 has an optional conductive layer 30. An optional hole blocking layer 34 can also be applied, as well as an optional adhesive layer 36. The charge generating layer 38 is located between the adhesive layer 36 and the charge transport layer 40. An optional ground strip layer 41 operatively connects the charge generating layer 38 and the charge transport layer 40 to the conductive layer 30. An optional overcoat layer 42 may also be included. An anti-curl back coating 33 is applied to the side of the substrate 32 opposite from the electrically active layers to render imaging member flatness.

Imaging members with the ACBC of the present disclosure avoid or minimize attacks by ozone species in the corona effluents, suppressing molecular chain scission in the ACBC and thereby extending the service life of the imaging member. The mechanism of protecting the polymer coating from chain scission degradation against ozone attack, as a result incorporating a vinyl (or allyl) containing liquid oligomer described above into the ACBC, can be illustrated with reference to the chemical reaction below:

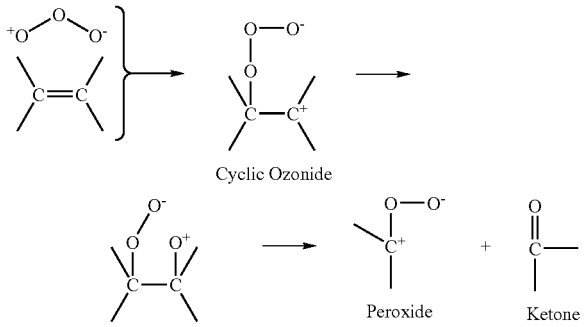

The anti-curl back coating (ACBC) comprises a film-forming polymer binder resin, a polyester adhesion promoter, and a liquid oligomer. A layer of from about 7 to about 30 micrometers in thickness is found to be adequately sufficient for balancing the curl and rendering the imaging member flat. The ACBC is optically transparent; it transmits at least about 98 percent of an incident light energy through the layer. It should also have good adhesion with the substrate.

The ACBC comprises a film-forming polymer and polyester adhesion promoter which, after drying, forms a polymer matrix. The polymer and the adhesion promoter should both be soluble in methylene chloride, chlorobenzene, or some other solvent suitable for use in the manufacturing process. Typical film-forming polymers soluble in methylene chloride include polycarbonate resin, polyvinylcarbazole, polyester, polyarylate, polyacrylate, polyether, polysulfone, polystyrene, polyamide, and the like. Molecular weights can vary from about 20,000 to about 250,000. In specific embodiments, the film-forming polymer is a polycarbonate resin.

Polycarbonate resins having a weight average molecular weight Mw of from about 20,000 to about 250,000 are suitable for use, and in embodiments from about 50,000 to about 120,000, may be used based on the ease of forming a coating solution having proper viscosity for application and on the mechanical strength of the resulting charge transport layer. The electrically inactive resin material may include poly(4,4'-dipropylidene-diphenylene carbonate) with a weight average molecular weight ($M_w$) of from about 35,000 to about 40,000, available as LEXAN 145 from General Electric Company; poly(4,4'-isopropylidene-diphenylene carbonate) with a molecular weight of from about 40,000 to about 45,000, available as LEXAN 141 from the General Electric Company; and a polycarbonate resin having a molecular weight of from about 20,000 to about 50,000 available as MERLON from Mobay Chemical Company. In specific embodiments, a poly(4,4'-isopropylidene diphenyl)carbonate known as MAKROLON, available from Mobay Chemical Company, and having a molecular weight of from about 130,000 to about 200,000, is used.

In one exemplary embodiment, the liquid oligomer is a diethylene glycol bis(allyl carbonate) represented by Formula (I):

FORMULA (I)

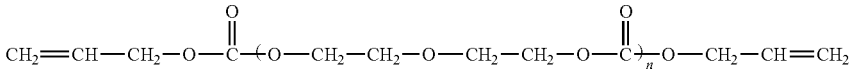

wherein n is an integer from about 1 to about 6. In a specific embodiment, n=1.

In another exemplary embodiment, the liquid oligomer is a bis(allyl carbonate) of bisphenol A shown as Formula (II) below:

FORMULA (II)

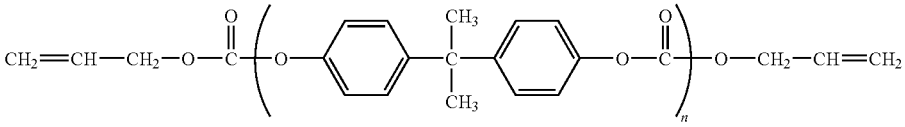

wherein n is an integer from about 1 to about 6. In a specific embodiment, n=1 and the carbonate is bis(allyl carbonate) of bisphenol A.

In addition, other alternative oligomers of aromatic Bisphenol A carbonate derived from the extension of Formula (II) suitable for the liquid oligomer are represented by Formulas (II-A), (II-B), and (II-C) wherein n is an integer from about 1 to about 6:

Formula (II-A)

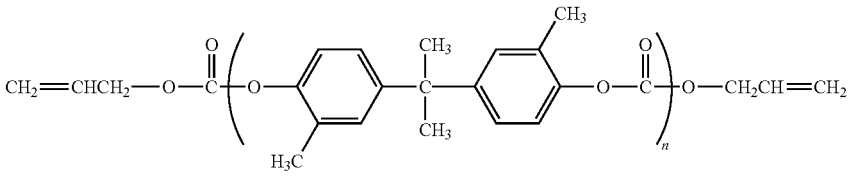

Formula (II-B)

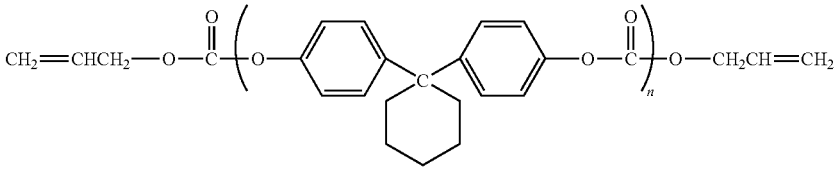

Formula (II-C)

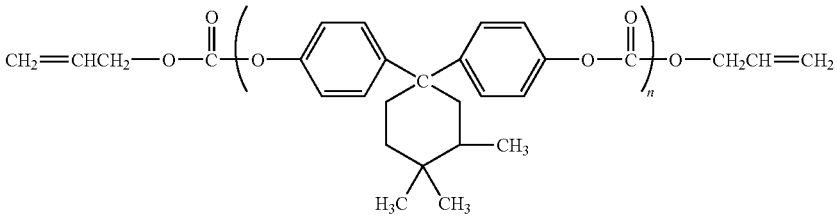

In another exemplary embodiment, the liquid oligomer is a polystyrene represented by Formula (III) below:

FORMULA (III)

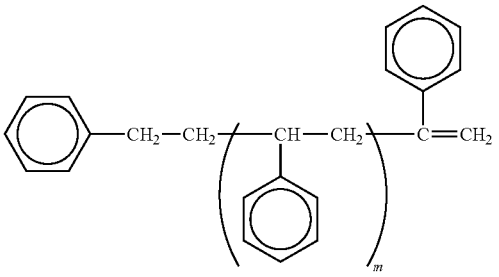

wherein m is the degree of polymerization and m is an integer from about 3 to about 10.

The liquid oligomer is selected based on its high compatibility with the film forming polymer. This simplifies coating solution preparation and insures that its presence in the coating layer matrix does not cause material phase separation in the resulting ACBC nor alter the adhesion bond strength between the ACBC and the substrate. The liquid oligomer comprises from about 2 to about 10 wt-% of the anti-curl back coating, based on the total weight of the anti-curl back coating. In further specific embodiments, the liquid oligomer comprises about 5 wt-% of the anti-curl back coating.

Inclusion of the liquid oligomer in the ACBC provides several advantages. First, it suppresses polymer degradation in the ACBC by protecting it from ozone attack. This provides better wear resistance and increases the life of the imaging member. Second, it flushes out any residual solvent remaining from the ACBC after the coating solution has been applied to the imaging member and dried. This reduces internal strain due to residual solvent outgassing. For example, it can flush out the residual solvent to a minimum of less than 0.3 wt-% of the ACBC.

The ACBC may further comprise a slip agent. The agent comprises from about 0.01 to about 5 wt-% of the anti-curl back coating, based on the total weight of the anti-curl back coating. In further specific embodiments, the slip agent comprises from about 0.5 to about 4 wt-% of the anti-curl back coating.

In one exemplary embodiment, the slip agent is a liquid polyester modified polysiloxane represented by Formula (IV) below:

FORMULA (IV)

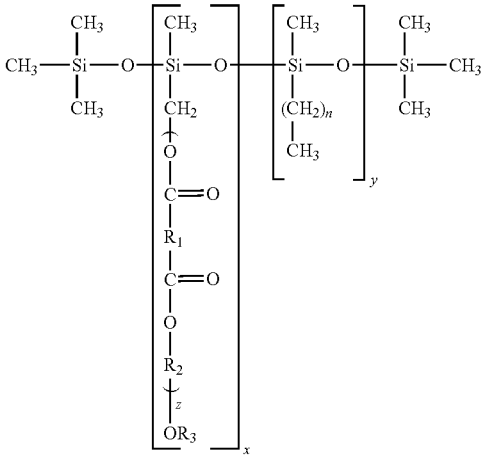

wherein R1 and R2 are independently selected from alkylene groups containing from 1 to 10 carbon atoms; R3 is hydrogen or alkyl having 1 to 3 carbon atoms; n is an integer from 0 to 10; x and y are independently integers from 5 to 500; and z is an integer from 1 to 30.

Polysiloxane liquids characterized by the formula above are commercially available slip agents, such as for example Byk 310®, available from Byk Chemie USA. The material is a chemically modified dimethipolysiloxane oligomers in which some of the methyl groups are extended and altered to give long organic side chains that increase the compatibility of the polysiloxane molecule with the film forming polycarbonate of the anti-curl layer and provide good side chain mechanical anchoring to the material matrix of the resulting anti-curl layer. Still another polyester modified polysiloxane is Byk 370®, available also from Byk Chemie USA. Preferably, the dried anti-curl layer contains between about 0.01 and about 5 percent by weight of the polysiloxane slip agent, based on the weight of the ACBC. The dried anti-curl layer containing the polysiloxane slip agent has a surface energy of between about 40 dynes/cm and about 22 dynes/cm.

Incorporating a slip agent into the ACBC has several advantages. It reduces the surface energy of the ACBC. This reduces the surface contact friction between the ACBC and mechanical parts such as belt rollers. It also lubricates the ACBC, reducing wear from, for example, mechanical sliding action over each surface of the belt support module's backer bars. This also reduces ACBC static charge build-up during imaging machine cyclic belt function.

The anti-curl layer of this disclosure may optionally contain organic and/or inorganic particles dispersed therein. The particles are easily dispersed by conventional coating solution mixing techniques and result in no particle agglomerations in the ACBC. Because the particles have inherent wear resisting characteristics, their presence in the material matrix should enhance the wear resistance of the ACBC. The particles have refractive indices closely matched with that of the polycarbonate so that particle dispersions in the ACBC matrix do not affect the optical transmittance of the layer. Also, the presence of the particles produces no adverse impact on the anti-curl capability and does not alter the adhesion bonding of the ACBC to the substrate. Examples of suitable organic particles include, but are not limited to, polytetrafluoroethylene polymers such as POLYMIST from Solvay Solexis and ZONYL from DuPont; waxy polyethylene such as ACUMIST or ACRAWAX; fatty amides such as erucamide, oleamide, and stearamide; KEVLAR; and stearates. Examples of suitable inorganic particles include, but are not limited to, silica; metal oxides; metal carbonate; metal silicates; and the like.

The ACBC also includes a small quantity of a saturated copolyester adhesion promoter to enhance its adhesion bond strength to the substrate support. In one embodiment, the saturated copolyester adhesion promoter (1) has a linear or branched structure including organic diacids, ethylene glycols, and diols and (2) is generally described as poly(1,4-cyclohexylene-dimethylene terephthalate/isophthalate). Typical copolyester adhesion promoters are VITEL polyesters from Goodyear Rubber and Tire Company, MOR-ESTER from Morton Chemicals, EASTAR PETG from Eastman Chemicals, and the like.

Other layers of the imaging member comprise a flexible supporting substrate 32, a conductive layer 30, an optional charge blocking layer 34, an optional adhesive layer 36, a charge generating layer 38, a charge transport layer 40, an optional ground strip layer 41, and an optional overcoat layer 42. Each of these layers is described below.

The substrate may be opaque, but is usually substantially transparent to allow imaging member back erase by light energy during the imaging process. The substrate may comprise numerous suitable materials having the required mechanical properties. When the substrate material is an electrically non-conductive material, the substrate may further be provided with an electrically conductive layer; i.e. the electrically conductive layer may be optional. Accordingly, the substrate may comprise a layer of an electrically non-conductive or conductive material such as an inorganic or organic composition. As electrically non-conducting materials, there may be employed various resins known for this purpose including polyesters, polycarbonates, polyamides, polyurethanes, and the like. The electrically insulating or conductive substrate may be flexible, semi-rigid, or rigid, and may have any number of different configurations such as, for example, a sheet, a scroll, an endless flexible belt, a cylinder, and the like. The substrate may be in the form of an endless flexible belt which comprises a commercially available biaxially oriented polyester known as MYLAR™, MELINEX™, and KALADEX™ available from E. I. du Pont de Nemours & Co.

The thickness of the substrate layer depends on numerous factors, including mechanical performance and economic considerations. The thickness of this layer, especially for a flexible imaging member belt, may range from about 50 micrometers to about 200 micrometers. The surface of the substrate layer is preferably cleaned prior to coating to promote greater adhesion of the deposited coating composition. Cleaning may be effected by, for example, exposing the surface of the substrate layer to plasma discharge, ion bombardment, and the like methods. However, in specific embodiments, the substrate has a thickness of from about 50 micrometers to about 125 micrometers, based on the considerations of optimum light energy transmission for effective back erase, adequate substrate flexibility, and cost impact. A substrate of polyethylene naphthalate (PEN) is also effectively used in embodiments of the present disclosure.

The conductive layer on the flexible substrate may vary in thickness over substantially wide ranges depending on the optical transparency and degree of flexibility desired for the electrophotographic member. Accordingly, for a flexible photoresponsive imaging device, the thickness of the conductive layer may be from about 20 angstrom units to about 750 angstrom units, and more preferably from about 100 Angstrom units to about 200 angstrom units for an optimum combination of electrical conductivity, flexibility and light transmission. The electrically conductive substrate surface layer may be an electrically conductive metal layer formed, for example, on the substrate by different coating technique, such as a vacuum depositing technique. Typical metals include aluminum, zirconium, niobium, tantalum, vanadium and hafnium, titanium, nickel, stainless steel, chromium, tungsten, molybdenum, and the like. Regardless of the technique employed to form the metal layer, a thin layer of metal oxide forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer. In embodiments, for rear erase exposure, an electrically conductive substrate surface layer light transparency of at least about 15% is desirable. The electrically conductive substrate surface layer need not be limited to metals. Other examples of electrically conductive substrate surface layers may be combinations of materials such as conductive indium tin oxide as a transparent layer for light having a wavelength between about 4000 Angstroms and about 7000 Angstroms or a transparent copper iodide (CuI) or a conductive carbon black dispersed in a plastic binder as an opaque conductive layer.

An optional charge blocking layer may be applied to the electrically conductive substrate surface layer. Generally, electron blocking layers for positively charged photoreceptors allow holes from the imaging surface of the photoreceptor to migrate toward the conductive layer. Any blocking layer capable of forming an electronic barrier to holes between the adjacent photoconductive layer and the underlying conductive layer may be utilized. The blocking layer may be nitrogen containing siloxanes or nitrogen containing titanium compounds as disclosed, for example, in U.S. Pat. No. 4,338,387, U.S. Pat. No. 4,286,033 and U.S. Pat. No. 4,291,110, the disclosures of which are incorporated herein by reference. In embodiments, a preferred blocking layer comprises a reaction product between a hydrolyzed silane and the oxidized surface of a metal ground plane layer. The blocking layer may be applied by different techniques such as spraying, dip coating, draw bar coating, gravure coating, silk screening, air knife coating, reverse roll coating, vacuum deposition, chemical treatment and the like. For convenience in obtaining thin layers, the blocking layers in embodiments are preferably applied in the form of a dilute solution, with the solvent being removed after deposition of the coating by techniques such as by vacuum, heating and the like. The blocking layer should be continuous and have a thickness of less than about 0.2 micrometer. A greater thickness may lead to undesirably high residual voltage.

An optional adhesive layer may be applied to the hole blocking layer. Typical adhesive layer materials include, for example, polyesters, DUPONT 49,000 (available from E. I. Du Pont de Nemours and Company), VITEL PE100 (available from Goodyear Tire & Rubber), and polyurethanes. In embodiments, satisfactory results may be achieved with an adhesive layer thickness from about 0.05 micrometer (500 Angstroms) to about 0.3 micrometer (3,000 Angstroms). Techniques for applying an adhesive layer coating mixture to the charge blocking layer include spraying, dip coating, roll coating, wire wound rod coating, gravure coating, bird applicator coating, and the like. Drying of the deposited coating may be effected by techniques such as oven drying, infrared radiation drying, air drying and the like.

A photogenerating layer or charge generating layer may be applied to the adhesive blocking layer which can then be overcoated with a contiguous charge transport layer as described hereinafter. Examples of photogenerating layers include inorganic photoconductive particles such as amorphous selenium, trigonal selenium, and selenium alloys comprising selenium-tellurium, selenium-tellurium-arsenic, selenium arsenide and mixtures thereof, and organic photoconductive particles including various phthalocyanine pigment such as the X-form of metal free phthalocyanine described in U.S. Pat. No. 3,357,989, the disclosure of which is incorporated herein by reference, metal phthalocyanines such as vanadyl phthalocyanine and copper phthalocyanine, dibromoanthanthrone, squarylium, quinacridones available from DuPont under the tradename MONASTRAL RED, MONASTRAL VIOLET, and MONASTRAL RED Y, VAT ORANGE 1 and VAT ORANGE 3 (tradenames for dibromo anthanthrone pigments), benzimidazole perylene, substituted 2,4-diamino-triazines disclosed in U.S. Pat. No. 3,442,781, the disclosure of which is incorporated herein by reference, polynuclear aromatic quinones available from Allied Chemical Corporation under the tradenames INDOFAST DOUBLE SCARLET, INDOFAST VIOLET LAKE B, INDOFAST BRILLIANT SCARLET, and INDOFAST ORANGE, dispersed in a film forming polymeric binder. Multi-photogenerating layer compositions may be utilized where a photoconductive layer enhances or reduces the properties of the photogenerating layer. Examples of this type of configuration are described in U.S. Pat. No. 4,415,639, the entire disclosure of which is incorporated by reference. Other photogenerating materials known in the art may also be utilized. Charge generating binder layers comprising particles or layers of a photoconductive material such as vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof may be utilized because of their sensitivity to white light. Vanadyl phthalocyanine, metal-free phthalocyanine and tellurium alloys may also be incorporated because these materials provide sensitivity to infrared light.

A polymeric film forming binder material may be employed as the matrix in the photogenerating binder layer. Typical polymeric film forming materials include those described, for example, in U.S. Pat. No. 3,121,006, the disclosure of which is incorporated herein by reference. Organic polymeric film forming binders include thermoplastic and thermosetting resins including polystyrene-co-4 vinyl pyridine, polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloridevinylchloride copolymers, vinylacetate-vinylidenechloride copolymers, styrene-alkyd resins, polyvinylcarbazole, and the like. These polymers may be block, random or alternating copolymers.

The photogenerating composition or pigment is present in the resinous binder composition in amounts, generally, of from about 5% by volume to about 90% by volume and is dispersed in from about 10% by volume to about 95% by volume of resinous binder, and in embodiments preferably from about 20% by volume to about 30% by volume of photogenerating pigment is dispersed in about 70% by volume to about 80% by volume of resinous binder composition. In one embodiment, about 8% by volume of photogenerating pigment is dispersed in about 92% by volume of resinous binder composition.

The photogenerating layer containing photoconductive compositions and/or pigments and the resinous binder material generally ranges in thickness of from about 0.1 micrometers to about 5 micrometers, and in embodiments has a thickness of from about 0.3 micrometers to about 3 micrometers. The photogenerating layer thickness is related to binder content. Higher binder content compositions generally require thicker layers for photogeneration.

Numerous techniques may be utilized to mix and thereafter apply the photogenerating layer coating mixture; these techniques include spraying, dip coating, roll coating, or wire wound rod coating. Drying of the deposited coating may be effected by different techniques such as oven drying, infra red radiation drying, air drying and the like.

The charge transport layer may include any suitable transparent organic polymer or non-polymeric material capable of supporting the injection of photogenerated holes and electrons from the charge generating layer and capable of allowing the transport of these holes or electrons through the organic layer to selectively discharge the surface charge. The active charge transport layer not only serves to transport holes or electrons, but also protects the photoconductive layer from abrasion or chemical attack and therefore extends the operating life of the photoreceptor imaging member. The charge transport layer should exhibit negligible, if any, discharge when exposed to a wavelength of light useful in xerography, e.g., about 4000 Angstroms to about 9000 Angstroms. Therefore, the charge transport layer is substantially transparent to radiation in a region in which the photoconductor is to be used. Thus, the active charge transport layer is a substantially non-photoconductive material which supports the injection of photogenerated charges from the charge generating layer. The active transport layer is normally transparent when exposure is effected through the active layer to ensure that most of the incident radiation is utilized by the underlying charge generating layer for efficient photogeneration. The charge transport layer in conjunction with the charge generating layer is a material which is an insulator to the extent that an electrostatic charge placed on the transport layer is not conducted in the absence of illumination.

An inactive thermoplastic resin binder soluble in methylene chloride or other solvent may be employed to form the thermoplastic polymer matrix of the charge transport layer of the imaging member. Typical inactive resin binders soluble in methylene chloride include polycarbonate resin, polyvinylcarbazole, polyester, polyarylate, polyacrylate, polyether, polysulfone, polystyrene, polyamide, and the like. Molecular weights can vary from about 20,000 to about 150,000. The film-forming binder is usually a polycarbonate resin.

The active charge transport layer may include any suitable charge transport molecule useful as an additive dispersed in electrically inactive polymeric materials making these materials electrically active. These charge transport molecules may be added to polymeric materials which are incapable of supporting the injection of photogenerated charges from the generation material and incapable of allowing the transport of these charges therethrough. This will convert the electrically inactive polymeric material to a material capable of supporting the injection of photogenerated charges from the generation material and capable of allowing the transport of these charges through the active layer in order to discharge the surface charge on the active layer.

Some diamines suitable for use as charge transport molecules include, but are not limited to, N,N,N',N'-tetra(o-methylphenyl)-[p-terphenyl]-4,4'-diamine; N,N'-bis(4-methylphenyl)-N,N'-bis[4-(1-butyl)-phenyl]-[p-terphenyl]-4,4'-diamine; N,N'-bis(3-methylphenyl)-N,N'-bis[4-(1-butyl)-phenyl]-[p-terphenyl]-4,4'-diamine; N,N'-bis(4-t-butylphenyl)-N,N'-bis[4-(1-butyl)-phenyl]-[p-terphenyl]-4,4'-diamine; N,N,N',N'-tetra[4-(1-butyl)-phenyl]-[p-terphenyl]-4,4'-diamine; N,N,N',N'-tetra[4-t-butyl-phenyl]-[p-terphenyl]-4,4'-diamine; N,N'-diphenyl-N,N'-bis(4-methylphenyl)-1,1'-biphenyl-4,4'-diamine; N,N'-bis(4-methylphenyl)-N,N'-bis(4-ethylphenyl)-1,1'-(3,3'-dimethylbiphenyl)-4,4'-diamine; 4,4'-bis(diethylamino)-2,2'-dimethyltriphenylmethane; N,N'-diphenyl-N,N'-bis(3-methylphenyl)-[1,1'-biphenyl]-4,4'-diamine (m-TBD); N,N'-diphenyl-N,N'-bis(alkylphenyl)-1,1'-biphenyl-4,4'-diamine; and N,N'-diphenyl-N,N'-bis(chlorophenyl)-1,1'-biphenyl-4,4'-diamine. Other known charge transport molecules are triphenylmethane; bis(4-diethylamino-2-methylphenyl)phenylmethane; stilbene; hydrazone; tritolylamine; and enamine phenanthrene diamine.

Polycarbonate resins having a weight average molecular weight Mw, of from about 20,000 to about 250,000 are suitable for use, and in embodiments from about 50,000 to about 120,000, may be used based on the ease of forming a coating solution having proper viscosity for application and on the mechanical strength of the resulting charge transport layer. The electrically inactive resin material may include poly(4,4'-dipropylidene-diphenylene carbonate) with a weight average molecular weight ($M_w$) of from about 35,000 to about 40,000, available as LEXAN 145 from General Electric Company; poly(4,4'-isopropylidene-diphenylene carbonate) with a molecular weight of from about 40,000 to about 45,000, available as LEXAN 141 from the General Electric Company; and a polycarbonate resin having a molecular weight of from about 20,000 to about 50,000 available as MERLON from Mobay Chemical Company. In specific embodiments, MAKROLON, available from Mobay Chemical Company, and having a molecular weight of from about 130,000 to about 200,000, is used. Methylene chloride is used as a solvent in the charge transport layer coating mixture for its low boiling point and the ability to dissolve charge transport layer coating mixture components to form a charge transport layer coating solution.

In embodiments, the charge transport layer comprises from about 25 weight percent (wt %) to about 75 wt % of a charge transport molecule and from about 75% to about 25% by weight of the film-forming polymeric binder resin, both by total weight of the charge transport layer. In specific embodiments, the charge transport layer comprises from about 45 wt % to about 55 wt % of all charge transport molecules and from about 55 wt % to about 45 wt % of the film-forming polymeric binder resin.

Different techniques may be utilized to mix and thereafter apply the charge transport layer coating mixture to the charge generating layer. Typical application techniques include spraying, dip coating, roll coating, wire wound rod coating, and the like. Drying of the deposited coating may be effected by different techniques such as oven drying, infra red radiation drying, air drying and the like.

Generally, the thickness of the charge transport layer is from about 10 to about 50 micrometers, but thicknesses outside this range can also be used. In general, the ratio of the thickness of the hole transport layer to the charge generating layer is in embodiments from about 2:1 to 200:1 and in some instances from about 2:1 to about 400:1.

A protective overcoat layer may be used to protect the charge transport layer against abrasion, scratching, and VOC attack. The overcoat layer is between about 1 to about 10 micrometers in thickness, and in specific embodiments a thickness of from about 2 to about 5 micrometers gives optimum mechanical/photoelectrical function. The overcoat comprises a thermoplastic film forming polymer and optionally a small quantity of charge transport molecules. The polymer and charge transport molecule may be selected from those listed for the charge transport layer. It may also contain a small amount of anti-oxidant, such as IRGANOX, to suppress corona species induced LCM problems or an antiozonant to protect against degradation. It may further include nanoparticle dispersions of silica, PTFE, and/or metal oxides to impart wear resistance.

The imaging member may also contain a narrow electrically conductive ground strip (not shown) coated at one edge of the imaging member belt in contact with the charge transport layer, charge generating layer and the conductive layer to effect electrical continuity. Ground strip formulations are well known; they are typically comprised of conductive particles dispersed in a film forming binder.

The development of the present disclosure will further be illustrated in the following non-limiting working examples, it being understood that these examples are intended to be illustrative only and that the disclosure is not intended to be limited to the materials, conditions, process parameters and the like recited herein. All proportions are by weight unless otherwise indicated.

EXAMPLES

Control Example 1

A flexible electrophotographic imaging member web was prepared by providing a 0.02 micrometer thick titanium layer coated on a substrate of a biaxially oriented polyethylene naphthalate substrate (KADALEX, available from DuPont Teijin Films.) having a thickness of 3.5 mils (89 micrometers). The titanized KADALEX substrate was extrusion coated with a blocking layer solution containing a mixture of 6.5 grams of gamma aminopropyltriethoxy silane, 39.4 grams of distilled water, 2.08 grams of acetic acid, 752.2 grams of 200 proof denatured alcohol and 200 grams of heptane. This wet coating layer was then allowed to dry for 5 minutes at 135° C. in a forced air oven to remove the solvents from the coating and effect the formation of a crosslinked silane blocking layer. The resulting blocking layer had an average dry thickness of 0.04 micrometer as measured with an ellipsometer.

An adhesive interface layer was then applied by extrusion coating to the blocking layer with a coating solution containing 0.16 percent by weight of ARDEL polyarylate, having a weight average molecular weight of about 54,000, available from Toyota Hsushu, Inc., based on the total weight of the solution in an 8:1:1 weight ratio of tetrahydrofuran/monochloro-benzene/methylene chloride solvent mixture. The adhesive interface layer was allowed to dry for 1 minute at 125° C. in a forced air oven. The resulting adhesive interface layer had a dry thickness of about 0.02 micrometer.

The adhesive interface layer was thereafter coated over with a charge generating layer. The charge generating layer dispersion was prepared by adding 0.45 gram of IUPILON 200, a polycarbonate of poly(4,4'-diphenyl)-1,1'-cyclohexane carbonate (PC-z 200, available from Mitsubishi Gas Chemical Corporation), and 50 milliliters of tetrahydrofuran into a 4 ounce glass bottle. 2.4 grams of hydroxygallium phthalocyanine Type V and 300 grams of ⅛ inch (3.2 millimeters) diameter stainless steel shot were added to the solution. This mixture was then placed on a ball mill for about 20 to about 24 hours. Subsequently, 2.25 grams of poly(4,4'-diphenyl-1,1'-cyclohexane carbonate) having a weight average molecular weight of 20,000 (PC-z 200) were dissolved in 46.1 grams of tetrahydrofuran, then added to the hydroxygallium phthalocyanine slurry. This slurry was then placed on a shaker for 10 minutes. The resulting slurry was thereafter coated onto the adhesive interface by extrusion application process to form a layer having a wet thickness of 0.25 ml. However, a strip of about 10 millimeters wide along one edge of the substrate web stock bearing the blocking layer and the adhesive layer was deliberately left uncoated by the charge generating layer to facilitate adequate electrical contact by a ground strip layer to be applied later. This charge generating layer comprised of poly(4,4'-diphenyl)-1,1'-cyclohexane carbonate, tetrahydrofuran and hydroxygallium phthalocyanine was dried at 125° C. for 2 minutes in a forced air oven to form a dry charge generating layer having a thickness of 0.4 micrometers.

This coated web stock was simultaneously coated over with a charge transport layer and a ground strip layer by co-extrusion of the coating materials. The charge transport layer was prepared by introducing into an amber glass bottle in a weight ratio of 1:1 (or 50 weight percent of each) of MAKROLON® 5705, a Bisphenol A polycarbonate thermoplastic having a molecular weight of about 120,000 commercially available from Farbensabricken Bayer A.G. and N,N'- diphenyl-N,N'-bis(3-methylphenyl)-1,1'-biphenyl-4,4'-diamine, a charge transport compound.

The resulting mixture was dissolved to give 15 percent by weight solid in methylene chloride. This solution was applied on the charge generating layer by extrusion to form a coating which upon drying in a forced air oven gave a charge transport layer 29 micrometers thick.

The strip, about 10 millimeters wide, of the adhesive layer left uncoated by the charge generator layer, was coated with a ground strip layer during the co-extrusion process. The ground strip layer coating mixture was prepared by combining 23.81 grams of polycarbonate resin (MAKROLON® 5705, 7.87 percent by total weight solids, available from Bayer A. G.), and 332 grams of methylene chloride in a carboy container. The container was covered tightly and placed on a roll mill for about 24 hours until the polycarbonate was dissolved in the methylene chloride. The resulting solution was mixed for 15-30 minutes with about 93.89 grams of graphite dispersion (12.3 percent by weight solids) of 9.41 parts by weight of graphite, 2.87 parts by weight of ethyl cellulose and 87.7 parts by weight of solvent (Acheson Graphite dispersion RW22790, available from Acheson Colloids Company) with the aid of a high shear blade dispersed in a water cooled, jacketed container to prevent the dispersion from overheating and losing solvent. The resulting dispersion was then filtered and the viscosity was adjusted with the aid of methylene chloride. This ground strip layer coating mixture was then applied, by co-extrusion with the charge transport layer, to the electrophotographic imaging member web to form an electrically conductive ground strip layer having a dried thickness of about 19 micrometers.

The imaging member web stock containing all of the above layers was then passed through 125° C. in a forced air oven for 3 minutes to simultaneously dry both the charge transport layer and the ground strip. The web stock, if unrestrained at this point, will spontaneously curl upwardly into a 1.5-inch tube.

An anti-curl coating was prepared by combining 88.2 grams of polycarbonate resin (MAKROLON® 5705) and 1,071 grams of methylene chloride in a carboy container to form a coating solution containing 8.9 percent solids. The container was covered tightly and placed on a roll mill for about 24 hours until the polycarbonate was dissolved in the methylene chloride to form the anti-curl back coating solution. The anti-curl back coating solution was then applied to the rear surface (side opposite the charge generating layer and charge transport layer) of the electrophotographic imaging member web by extrusion coating and dried to a maximum temperature of 120° C. in a forced air oven for 2 minutes to produce an optically transparent dried anti-curl back coating having a thickness of 17 micrometers.

Disclosure Example 1

A flexible electrophotographic imaging member web was fabricated using the same materials and the same process as that described in Control Example 1, except that the anti-curl back coating solution was prepared to include a Bisphenol A bisallyl carbonate monomer as shown in Formula (II) (HIRI®, commercially available from PPG, Inc.). The coating solution was then applied onto the rear surface of an imaging member web and followed by subsequent drying at elevated temperature to give an imaging member web stocks having 5 wt % HIRI® based on the resulting dried weight of the anti-curl back coating. The thickness of the layer was 17 micrometers.

Ozone Exposure Testing

To assess the extent of polycarbonate degradation as a result of ozone exposure, 8"×10" free standing anti-curl back coating (ACBC) coatings were prepared according to Control Example 1 and Disclosure Example 1 and subjected to an ozone exposure test. In essence, two sets of test samples were cut from each free standing coating for testing. One set was subjected to an ozone exposure test from corona effluent and the other unexposed set was used as a control. Corona effluents were generated by turning on a charging device in an enclosed large glass tube operated under 700 micro-amperes and 8 KV conditions. The corona effluent exposure test was accomplished by placing each ACBC coating inside an enclosed glass tube and simultaneously exposing the coating to the ozone containing gaseous effluents generated by the charging device for 6 hours. All four ACBC coatings were then analyzed by Gel Permeation Chromatography (GPC) for MAKROLON molecular weight distribution comparison to assess the extent of polymer degradation due to ozone attack. The results obtained are given in Table A below:

TABLE A

| SAMPLE ID | Mw (Kpse) | Mn (Kpse) | Mp (Kpse) |
|---|---|---|---|
| Disclosure Example 1 exposed | 90.7 | 4.1 | 133 |
| Disclosure Example 1 control | 163 | 37 | 146 |
| Control Example 1 exposed | 30.1 | 4.9 | 37.6 |
| Control Example 1 control | 163 | 40 | 140 |

In the above table, Mw is weight average molecular weight, Mn is number average molecular weight, and Mp is the peak molecular weight. The data showed that molecular degradation of MAKROLON caused by ozone attack in the Control Example 1 ACBC coating was very severe, while addition of HIRI® in the Disclosure Example 1 ACBC coating provided effective protection against polymer chain scission that would otherwise have occurred as seen in the Mw and Mn columns.

To assess the impact of polymer degradation on the wear properties of the anti-curl back coating, the ACBC surfaces of the imaging members (each cut to give 2"×12" test samples) of Control Example 1 and Disclosure Example 1 were both exposed to corona effluents according to the procedures described above. They were then evaluated for susceptibility to wear by subjecting the sample to a mechanical sliding wear testing method.

The wear testing was conducted by means of a dynamic mechanical cycling device in which glass tubes were skidded across the surface of the ACBC on each imaging member. More specifically, one end of the test sample was clamped to a stationary post and the sample was looped upwardly over three equally spaced horizontal glass tubes and then downwardly over a stationary guide tube through a generally inverted "U" shaped path with the free end of the sample secured to a weight which provided one pound per inch (0.17 kilogram per cm) width tension on the sample. The outer surface of the imaging member cut piece bearing the ACBC faced downwardly so that it would periodically be brought into sliding mechanical contact with the glass tubes to effect wear. The glass tubes had an outer diameter of one inch.

Each tube was secured at each end to an adjacent vertical surface of a pair of disks that were rotatable about a shaft connecting the centers of the disks. The glass tubes were parallel to and equidistant from each other and equidistant from the shaft connecting the centers of the disks. Although the disks were rotated about the shaft, each glass tube was rigidly secured to the disk to prevent rotation of the tubes around each individual tube axis. Thus, as the disk rotated about the shaft, two glass tubes were maintained at all times in sliding contact with the outer surface of the ACBC. The axis of each glass tube was positioned about 4 cm from the shaft. The direction of movement of the glass tubes along the ACBC surface was away from the weighted end of the sample toward the end clamped to the stationary post. Since there were three glass tubes in the test device, each complete rotation of the disk was equivalent to three wear cycles in which the surface of the ACBC was in sliding mechanical contact with a single stationary support tube during the testing. The rotation of the spinning disk was adjusted to provide the equivalent of 11.3 inches (28.7 cm.) per second tangential speed. The extent of ACBC wear was measured using a permascope at the end of a 90K wear cycles test. The results given in Table B below demonstrate the effectiveness of 5 wt % HIRI® in imparting wear resistance.

TABLE B

| SAMPLE ID | Amt of HIRI ® | Amt of ACBC worn off after 90K wear cycles |
|---|---|---|
| Control Example 1 exposed | 0 | 2.4 microns |
| Disclosure Example 1 exposed | 5% | 1.6 microns |

Disclosure Example 2

Three flexible electrophotographic imaging member webs were fabricated using the same materials and the same process as described in Disclosure Example 1, except that the anti-curl back coating solution also contained slip agent (from BYK-Chemie USA). The resulting three webs incorporated 5 wt % HIRI® and 0.5, 2, and 4 wt % slip agent respectively, based on the total weight of the anti-curl back coating.

Friction, Wear, and Lubricity Testing

The coefficient of friction, wear resistance, and lubricity of the three ACBCs of Disclosure Example 2 were evaluated against the ACBC of Control Example 1 (which had no HIRI or slip agent). The coefficient of friction (CoF) was measured against a charge transport layer (CTL) (made of 50 wt % MAKROLON and 50 wt % N,N'-diphenyl-b,N'-bis(3-methylphenyl)-1,1'-biphenyl-4,4'-diamine) and also against ACT rubber. The ACT rubber simulated mechanical interaction between the ACBC and the belt support drive-roll during dynamic imaging belt machine function conditions. Wear resistance was carried out as described above. Lubricity was assessed using adhesion strength measurement of Scotch® Magic Tape 810 (available from 3M) 180° peeling off from the ACBC. The results are given in Table C below:

TABLE C

| SAMPLE ID | CoF against ACT Rubber | CoF against CTL | Amt of ACBC worn off after 90K wear cycles | 180° Tape Peel (gm/cm) |
|---|---|---|---|---|
| Control | 1.20 | 3.2 | 2.5 microns | 390 |
| 0.5 wt % slip agent | 1.05 | 1.7 | 1.9 microns | 240 |
| 2 wt % slip agent | 1.01 | 1.4 | 1.8 microns | 245 |
| 4 wt % slip agent | 1.02 | 1.4 | 1.6 microns | 237 |

The data showed that the slip agent was efficient in lowering the surface energy of the ACBC, as reflected in the lowering tape peel strength. It also lubricated the ACBC, reducing wear-off as reflected in the wear cycle results; this is due to the lower sliding resistance between the ACBC and the glass contacting surfaces. The reduction in interfacial contact friction was reflected in the lower coefficients of friction against CTL. Though the coefficient of friction was slightly reduced against the ACT rubber, this reduction was not substantial enough to cause belt slippage problems. In other words, the belt module's driving roller would still be able to grip this ACBC well enough to drive and spin the imaging belt. In addition, the lubricity effect provided by the slip agent was further supported by water contact measurements which showed that all the ACBCs of Disclosure Example 2 had a water contact angle approximately 16° higher than the ACBC of Control Example 1.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

The invention claimed is:

1. An electrophotographic imaging member comprising:

a flexible substrate;

a charge generating layer;

a charge transport layer; and an anti-curl back coating;

wherein the anti-curl back coating comprises a film-forming polymer, an adhesion promoter, a slip agent, and a liquid oligomer;

wherein the liquid oligomer is selected from the group consisting of a compound represented by Formula (II-A) below:

Formula (II-A)

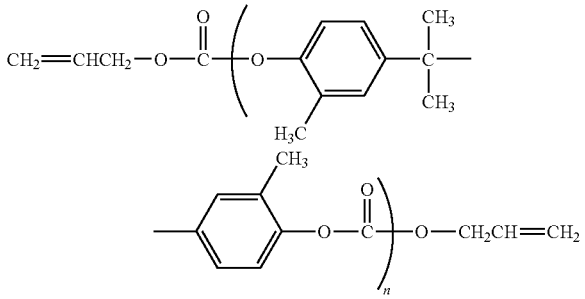

wherein n is an integer from about 1 to about 6; a compound represented by Formula (II-B) below:

Formula (II-B)

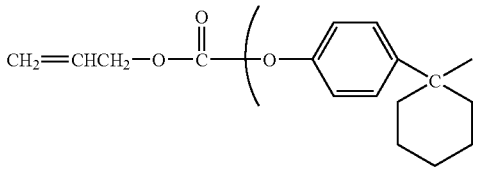

-continued

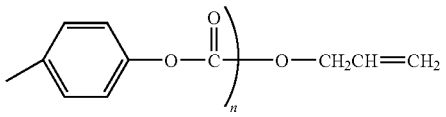

wherein n is an integer from about 1 to about 6; and a compound represented by Formula (II-C) below:

Formua (II-C)

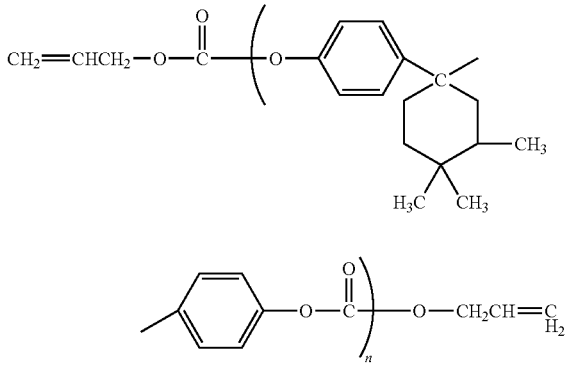

wherein n is an integer from about 1 to about 6; and wherein the slip agent is present in the amount of from about 0.01 to about 5 wt-% of the anti-curl back coating, based on the total weight of the anti-curl back coating.

2. The imaging member of claim 1, wherein the liquid oligomer comprises from about 2 to about 10 wt-% of the anti-curl back coating, based on the total weight of the anti-curl back coating.

3. The imaging member of claim 1, wherein the slip agent is present in the amount of from about 0.5 to about 4 wt-% of the anti-curl back coating, based on the total weight of the anti-curl back coating.

4. The imaging member of claim 1, wherein the slip agent is a liquid polyester modified polysiloxane represented by Formula (IV) below:

FORMULA (IV)

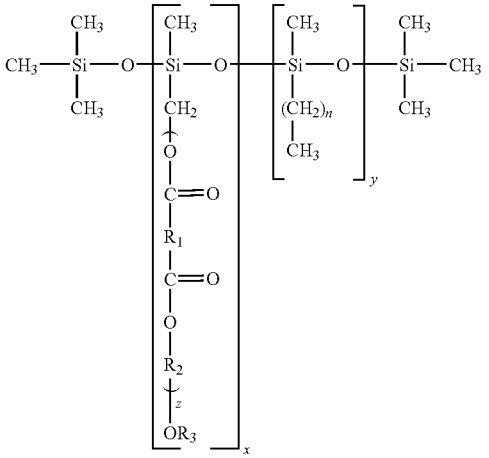

wherein $R_1$ and $R_2$ are independently selected from alkylene groups containing from 1 to 10 carbon atoms; $R_3$ is hydrogen or alkyl having 1 to 3 carbon atoms; n is an integer from 0 to 10; x and y are independently integers from 5 to 500; and z is an integer from 1 to 30.

5. The imaging member of claim 1, wherein the anti-curl back coating further comprises a particle dispersion.

6. The imaging member of claim 5, wherein the particles of the particle dispersion are organic particles selected from the group consisting of polytetrafluoroethylene polymers, waxy polyethylene, fatty amides, oleamide, and stearamide.

7. The imaging member of claim 5, wherein the particles of the particle dispersion are inorganic particles selected from the group consisting of silica, metal oxides, metal carbonate, metal silicates, and metal stearates.

8. A method of imaging which comprises generating an electrostatic latent image on the imaging member of claim 1, developing the latent image and transferring the developed electrostatic image to a receiving substrate.

9. An electrographic imaging member comprising:

a flexible substrate;

one or more layers comprising a charge generating material and a charge transport material; and, an anti-curl back coating;

wherein the anti-curl back coating comprises a liquid oligomer and a slip agent;

wherein the liquid oligomer is selected from the group consisting of a compound represented by Formula (II-A) below:

Formula (II-A)

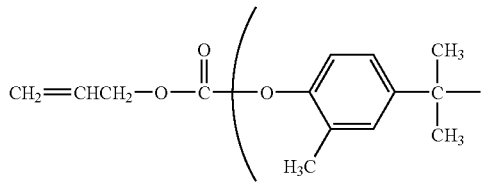

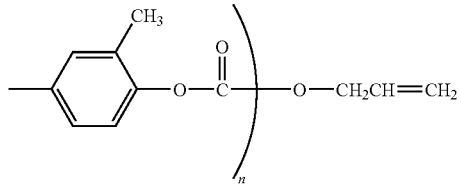

wherein n is an integer from about 1 to about 6; a compound represented by Formula (II-B) below:

Formula (II-B)

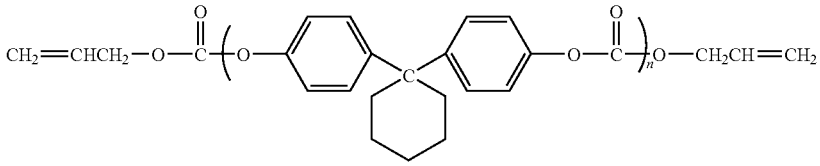

wherein n is an integer from about 1 to about 6; and a compound represented by Formula (II-C) below:

Formula (II-C)

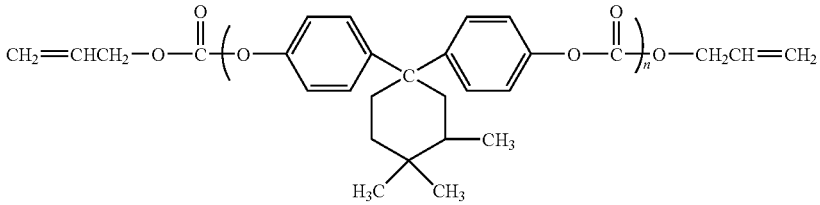

wherein n is an integer from about 1 to about 6; and wherein the slip agent is present in the amount of from about 0.01 to about 5 wt-% of the anti-curl back coating, based on the total weight of the anti-curl back coating.

10. The imaging member of claim 9, wherein the liquid oligomer comprises from about 2 to about 10 wt-% of the anti-curl back coating, based on the total weight of the anti-curl back coating.

* * * * *